US005137218A

United States Patent [19]

Sutherland et al.

[11] Patent Number: 5,137,218

[45] Date of Patent: Aug. 11, 1992

[54] PULVERIZER FOR REDUCING THE POSSIBILITY OF EXPLOSIONS

[75] Inventors: Richard E. Sutherland, Sawyer; Billy L. Doss, Idabel; Timothy F. Hogan, Hugo, all of Okla.

[73] Assignee: Western Farmers Electric Cooperative, Fort Towson, Okla.

[21] Appl. No.: 749,805

[22] Filed: Aug. 26, 1991

[51] Int. Cl.[5] ..... B02C 23/00

[52] U.S. Cl. ..... 241/31; 241/57; 241/41

[58] Field of Search ..... 241/31, 57, 41

[56] References Cited

U.S. PATENT DOCUMENTS 3,912,015 10/1975 Garbee et al. ..... 241/31 X
4,244,529 1/1981 DeGabriele et al. ... 241/DIG. 14 X
4,754,932 7/1988 Kmiotek et al. ..... 241/31
4,919,341 4/1990 Lohnherr ..... 241/57 X
4,928,891 5/1990 Richardson et al. ..... 241/57 X

OTHER PUBLICATIONS

Brochure, Pulverizer Inerting and Clearing Control Box Operating Instructions for Western Farmers Electric Cooperative, Sep. 7, 1979.

Brochure, Pulverized Fuel Systems Type MPS 89 Pulverizer Operating Instructions, Feb. 2, 1981.

*Primary Examiner*—Mark Rosenbaum
*Assistant Examiner*—Frances Chin
*Attorney, Agent, or Firm*—Dunlap, Codding & Lee

[57] ABSTRACT

To reduce the possibility of explosions, an upper fogging header having a plurality of nozzles is connected to the pulverizer and the operation of the upper fogging header, a lower fogging header and a primary duct fogging header is automated.

6 Claims, 4 Drawing Sheets

PULVERIZER FOR REDUCING THE POSSIBILITY OF EXPLOSIONS

FIELD OF THE INVENTION

The present invention relates to improvements in pulverizers for reducing the possibility of explosions wherein the improvement comprises an upper fogging header and the automatic operation of the upper fogging header, a lower fogging header, and a primary duct fogging header for spraying water into portions of a pulverizer chamber and a primary air duct for cooling the air and facilitating the movement of coal dust onto the bottom of a pyrite chamber.

BRIEF DESCRIPTION OF THE DRAWINGS

FIG. 6 is a view showing a portion of a pyrite chamber in the pulverizer and showing a portion of the lower fogging header and a portion of the swirl header.

FIG. 6A is a top plan view of the lower fogging header.

DESCRIPTION OF THE PREFERRED EMBODIMENTS

Figure 1:
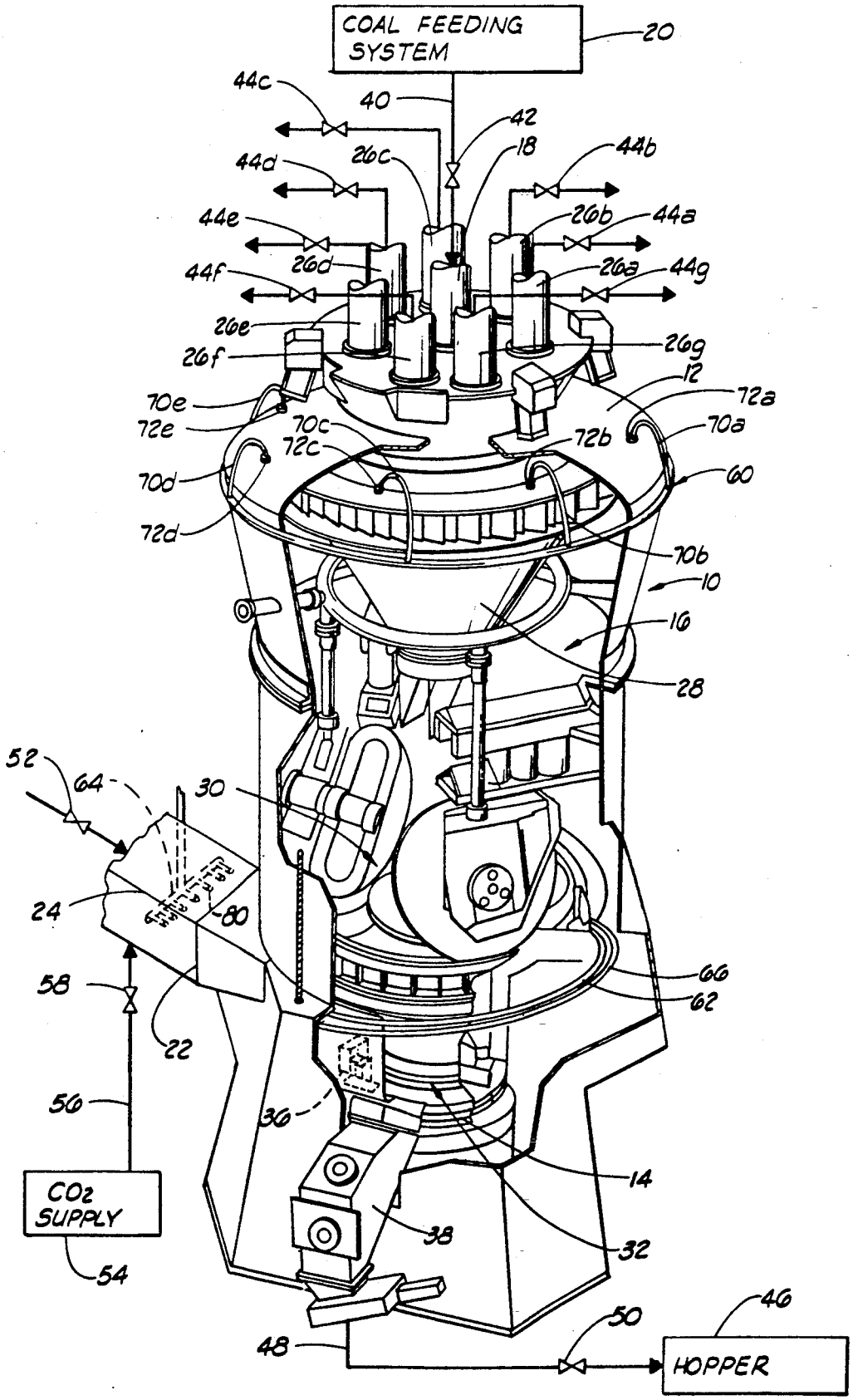
FIG. 1 is a diagrammatic, schematic view of a pulverizer incorporating the improvements of the present invention.

Diagrammatically shown in FIG. 1 is a pulverizer designated by the general reference numeral 10. The pulverizer 10 has an upper end 12, a lower end 14 and encompasses a pulverizer chamber 16. The pulverizer 10 has an inlet 18 in the upper end 12 which is connected to a coal feeding system 20 for feeding coal into the pulverizer chamber 16 via the inlet 18. The pulverizer 10 also has a hot air inlet 22 disposed near and spaced a distance from the lower end 14 which is connected to a primary air duct 24 for passing hot air through the primary air duct 24 and into the pulverizer chamber 16 for moving the ground coal dust through the pulverizer chamber 16 and out coal outlets 26 (7 coal outlets being shown in FIG. 1 and designated therein by the reference numerals 26*a*, 26*b*, 26*c*, 26*d*, 26*e*, 26*f* and 26*g*).

The coal is passed into the inlet 18 and through a funnel 28 into grinders 30. The grinders 30 grind the coal into fine coal dust and the hot air blows the ground coal dust out from the pulverizer chamber 16 through the coal outlets 26. The pulverizer 10 also includes a pyrite chamber 32 near the lower end 12. Debris such as large chunks of coal or metal or other debris falls from the grinders onto a bottom 34 (FIG. 6) of the pyrite chamber 32.

Blades 36 (only one of the blades 36 being designated by a reference numeral in FIG. 1) are movable supported in the pyrite chamber 32. The blades are movable through the pyrite chamber 32 for engaging the debris in the pyrite chamber 32 and moving the debris toward a debris outlet 38 where the debris is discharged from the pulverizer.

The coal feeding system 20 comprises a supply of coal which is disposable on a feeder conveyor for conveying into and through a conduit 40 for passing coal into the inlet 18. A motor operated gate valve 42 is interposed in the conduit 40.

A valve 44 is interposed in each of the coal outlets 26. The individual valves 44 designated in FIG. 1 by the respective reference numerals 44*a*, 44*b*, 44*c*, 44*d*, 44*e*, 44*f* and 44*g*.

The debris outlet 38 is connected to a hopper 46 by way of a conduit 48. A valve 50 is interposed in the conduit 48.

A control damper 52 (FIGS. 2 and 3) is interposed in the primary air duct 24 for opening and closing the primary air duct 24. The damper 52 is schematically shown in FIGS. 2 and 3.

A $CO_2$ supply 54 is connected to the primary air duct 24 by way of a conduit 56. A valve 58 is interposed in the conduit 56.

Figure 2:
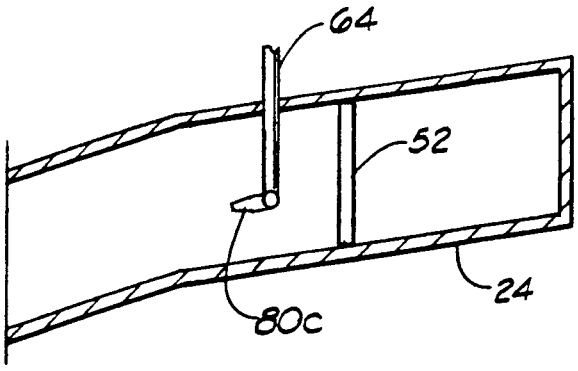
FIG. 2 is a side elevational view of a portion of a primary air duct having a primary duct fogging header disposed therein.
Figure 3:
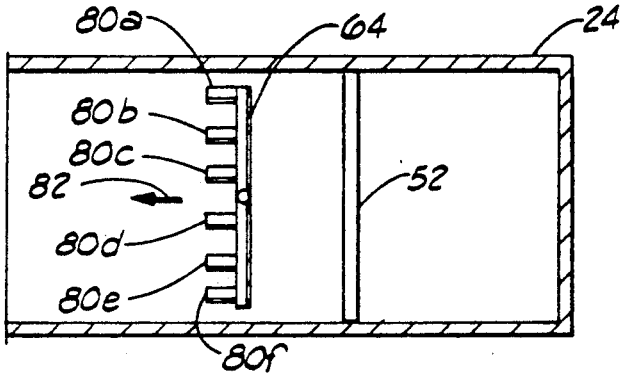
FIG. 3 is a top sectional view of the primary air duct of FIG. 2 showing the primary duct fogging header disposed thereon.
Figure 5:
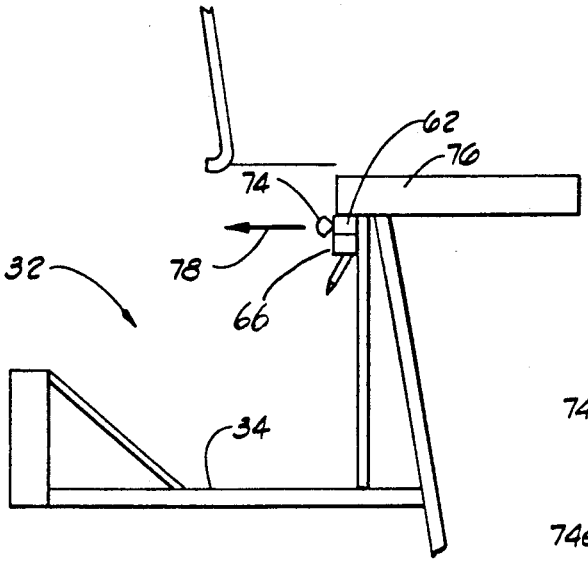
FIG. 5 is a top elevational view of the swirl header.
Figure 5A:
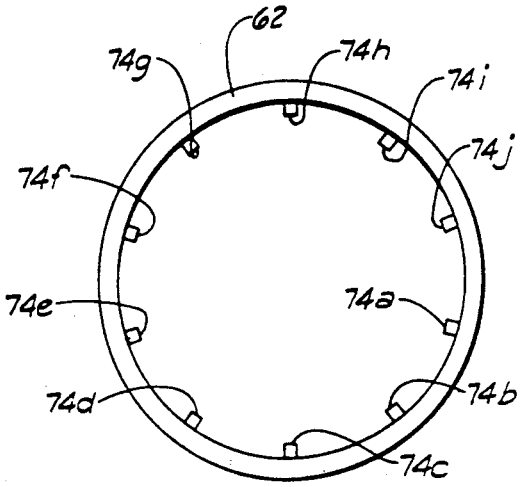
Figure 5:
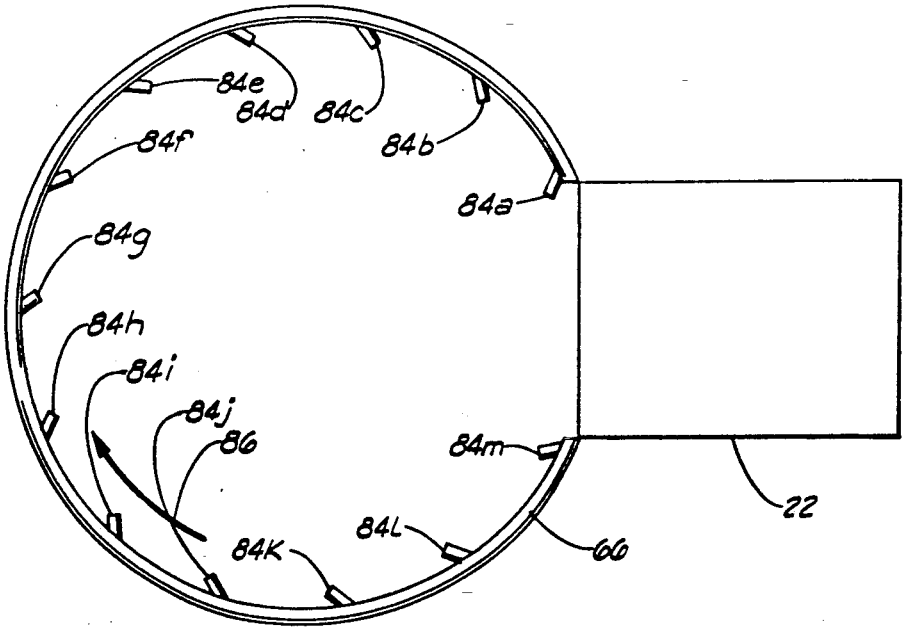

The pulverizer 10 includes a lower fogging header 62 (FIGS. 1, 6 and 6A) and a primary duct fogging header 64 (FIGS. 1, 2 and 3). The pulverizer 10 also includes a swirl header 66 (FIGS. 1, 5 and 6).

Pulverizers of the type just described commonly are used in the production of electricity wherein the coal dust is fed from the coal outlets 26 into burners, the particular pulverizer 10 shown in FIG. 1 having 7 coal outlets 26 with each of the coal outlets 26 feeding coal to one burner. Pulverizers of the type just described with respect to the pulverizer 10 are well known in the art and a detailed description of the construction and operation of such pulverizers is not deemed necessary herein.

When pulverizers such as the pulverizer 10 are shut down, coal dust and hot air are left in the pulverizer chamber 16 and in the primary air duct 24. This remaining coal dust has resulted in explosions within the primary air duct 24 and within the pulverizer chamber 16. The present invention provides improvements in the pulverizer 10 for substantially reducing the possibility of explosions occurring in the primary air duct 24 and the pulverizer chamber 16 after the shut down of the pulverizer 10.

The improvements of the present invention basically comprise an upper fogging header 60 (FIGS. 1 and 4), and the automatic operation of the upper fogging header 60, lower fogging header 62 the primary duct fogging header 64 and the swirl header 66. The present invention is designed to accomplish the following:

1. To contain all the coal within the confines of the pulverizer 10;
2. To prevent any coal dust from laying out in the primary air duct 24;
3. To saturate the coal in the pulverizer 10 with water;
4. To provide a source of water in the pyrites section;
5. The removal of fuel from the pulverizer 10 prior to re-starting the pulverizer 10; and
6. To permit cooling of the pulverizer 10 such that the temperature inside the pulverizer 10 is within specification for restarting the pulverizer 10.

Figure 4:
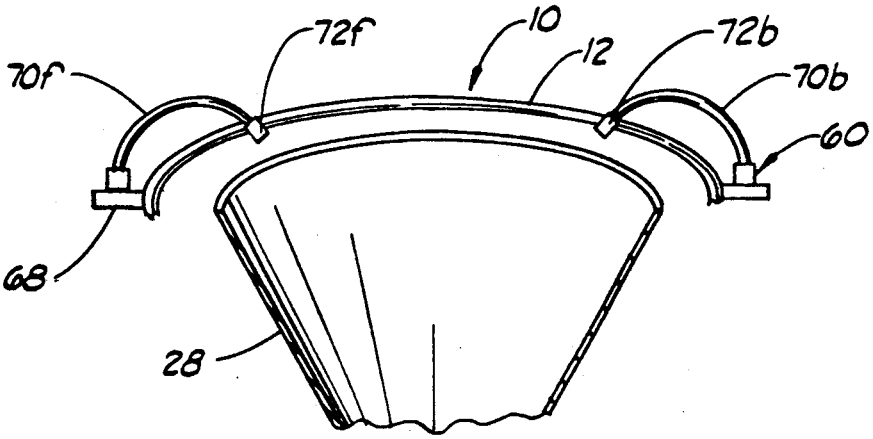
FIG. 4 is a schematic view showing a portion of the upper end of the pulverizer and showing a portion of the upper fogging header.

Referring to FIGS. 1 and 4, the upper fogging header 60 is connected to the upper end 12 of the pulverizer 10.

The upper fogging header 60 is circular in shape. The upper fogging header 60 is connected to a circular support 68 which is secured to the outside of the pulverizer 10. A plurality of conduits 70 are connected to the header and each of the conduits 70 extends a distance from the header and through the upper end 12 of the pulverizer 10. The individual conduits are designated in FIGS. 1 and 4 by the individual reference numerals 70*a*, 70*b*, 70*c*, 70*d*, 70*e* and 70*f*. More particularly, six conduits 70 are connected to the upper fogging header 60 with five of the conduits 70 being shown in FIG. 1 and the other conduit 70*f* being shown in FIG. 4 along with the conduit 70*b*.

A nozzle 72 is connected to the end of each conduit 70, opposite the end of the conduit 70 which is connected to the upper fogging header 60. The individual nozzles are designated in FIGS. 1 and 4 by the reference numerals 72*a*, 72*b*, 72*c*, 72*d*, 72*e* and 72*f*. Each of the nozzles 72 on the upper fogging header 60 is positioned to spray water into the pulverizer chamber 16 generally near the upper end 12 and generally about the coal outlets 26. The nozzles 72 in one embodiment are manufactured by Spraying Systems Co. of Wehaton, Ill., ⅜-BD-SS-20-10.

The upper fogging header 60, the lower fogging header 62 and the swirl header 66 in one embodiment preferably each is 1½ inches by 1½ inches square with a 3/16ths wall, rolled on 72 inch radius, manufactured by A & E Machine, Lone Star, Tex.

As shown in FIGS. 1 and 6A, the lower fogging header 62 is generally circularly shaped. Ten nozzles 74 are connected to the lower fogging header 62 with the nozzles 74 being spaced circumferentially about the lower fogging header 62. Each of the nozzles 74 is positioned to spray water in a direction generally radially inwardly from the lower fogging header 62 into the pyrites chamber 32 or, in other words, the pulverizer chamber 16 near the lower end 14 of the pulverizer 10. The individual nozzles are shown in FIG. 6A and designated therein by the reference numerals 74*a*, 74*b*, 74*c*, 74*d*, 74*e*, 74*f*, 74*g*, 74*h*, 74*i* and 74*j*. In one embodiment, the nozzles 74 are manufactured by Spraying Systems Co. of Wheaton, Ill., ⅜-BD-SS-20-10.

The lower fogging header 62 is connected to a brace 76 in the pyrite chamber 32 positioned a distance above the bottom 34 of the pyrite chamber 32. The nozzles 74 are positioned to spray water in a direction 78 (FIG. 6) radially inwardly from the lower fogging header 62.

The primary duct fogging header 64 is positioned within the primary air duct 24, as shown in FIGS. 1, 2 and 3. The header 64 extends across the primary air duct 24. A plurality of nozzles 80 are connected to the primary duct fogging header 64. The individual nozzles are designated in FIG. 3 by the respective reference numerals 80*a*, 80*b*, 80*c*, 80*d*, 80*e* and 80*f*. Only one of the nozzles 80 is designated with a reference numeral in FIG. 1. The nozzles 80 are spaced apart along the length of the primary duct fogging header 64. Each of the nozzles 80 is positioned in the primary air duct 24 to spray water in a direction 82 (FIG. 3) generally toward the hot inlet 22 of the pulverizer 10. The nozzles 80 are supplied by Spraying Systems Company, Wheaton, Ill., 38-HH-SS-18SQ.

As shown in FIGS. 1 and 5, the swirl header 66 is positioned in the pyrite chamber 32 generally below the lower fogging header 62 and spaced a distance above the bottom 34. The swirl header 66 is generally circular in shape. A plurality of nozzles 84 is connected to the swirl header 66. More particular, thirteen nozzles 84 are connected to the swirl header 66. The nozzles 84 are spaced circumferentially about the swirl header 66 and each of the nozzles 84 is angled to spray water in a general direction 86 corresponding to the direction of movement of the blades 36 for facilitating the movement of debris in the pyrite chamber 32 toward the debris outlet 38. Each of the nozzles 84 also is angled downwardly generally toward the bottom 34 of the pyrite chamber 32. The nozzle 34 in one embodiment are manufactured by Spraying Systems Company of Wheaton, Ill., ⅜-BD-SS-20-10.

Figure 7:
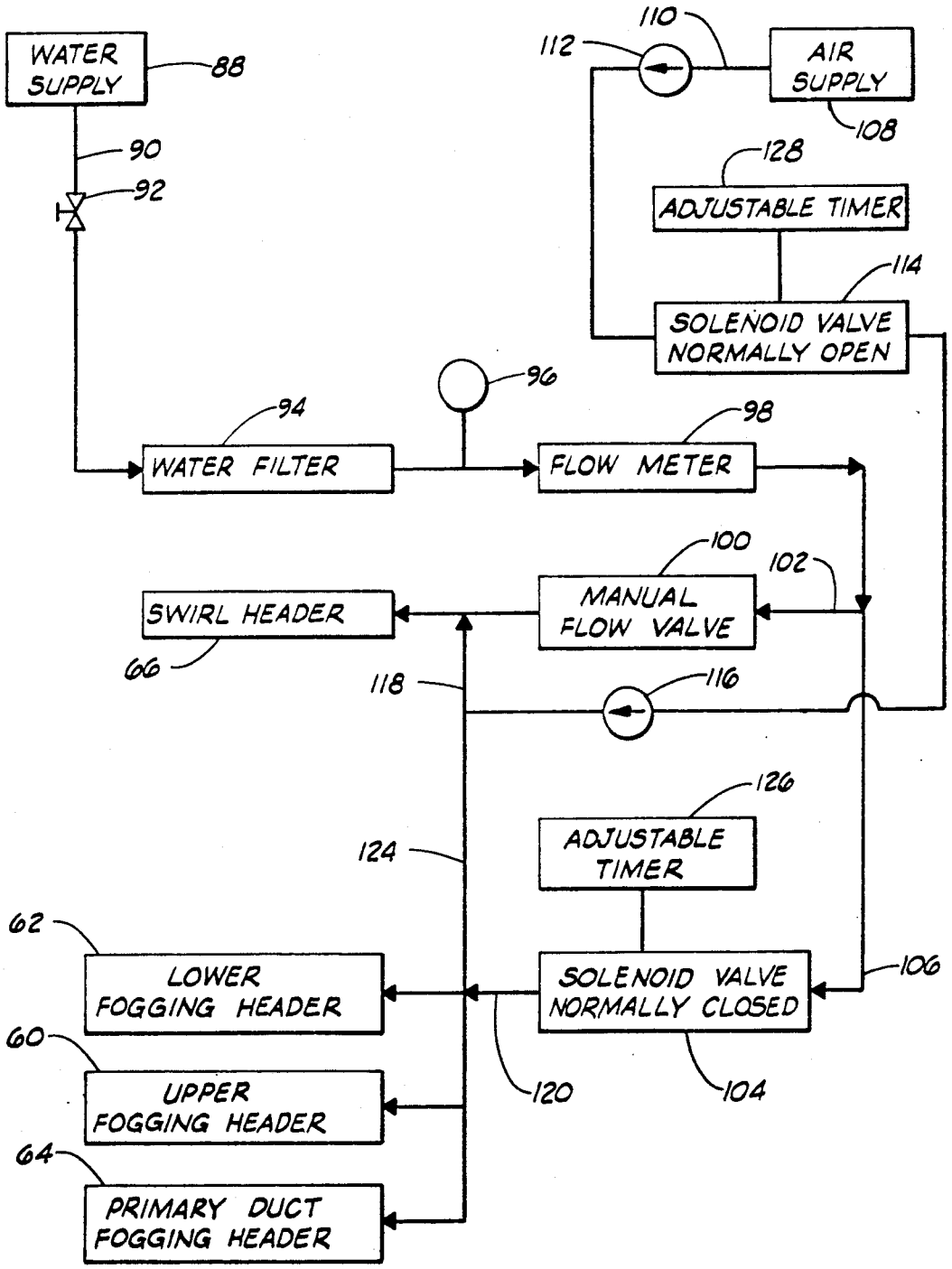
FIG. 7 is a schematic view showing the water and air connections to the lower fogging header, upper fogging header, primary duct fogging header and swirl header.

As shown in FIG. 7, each of the headers 60, 62, 64 and 66 is connected to a water supply 88 by way of a conduit 90. A manually shut off valve 92 is interposed in the conduit 90. A water filter 94, pressure gauge 96 and a flow meter 98 each are interposed in the conduit 90 downstream from the shut off valve 92. The water flowing through the conduit 90 is passed through a solenoid/manual flow valve 100 by way of a conduit 102 and into the swirl header 66. Water flowing through the conduit 90 is passed through a solenoid valve 104 by way of a conduit 106 and into the headers 60, 62 and 64.

An air supply 108 is connected to the headers 60, 62, 64 and 66 by way of a conduit 110. A check valve 112 is interposed in the conduit 110 and a solenoid valve 114 is interposed in the conduit 110 downstream from the check valve 112. A check valve 116 is interposed in the conduit 110 downstream from the solenoid valve 114.

Air is passed from the air supply 108 to the swirl header 66 by way of a conduit 118. Air is passed through the solenoid valve 104 and into the headers 60, 62 and 64 by way of a conduit 120. An adjustable timer 126 is connected to the solenoid valve 104 and an adjustable timer 128 is connected to the solenoid valve 114.

In operation, coal is flowing from the coal feeding system 20 into the pulverizer 10 wherein the coal is ground into a coal dust which is disposed in the pulverizer chamber 16. Hot air is flowing through the primary air duct 24 and into the pulverizer chamber 16 wherein the hot air blows the coal dust through the pulverizer chamber 16 and out the coal outlets 26. In this position, the control damper 52 is in the opened position, the valves 44 in the opened position and the valve 42 is in the opened position.

In the operating condition of the pulverizer 10, the solenoid valve 114 (FIG. 7) is opened and the solenoid valve 104 (FIG. 7) is closed. Further, the solenoid/-manual flow valve 100 is closed. In this operating condition, water is not passed from the water supply 88 to any of the headers 60, 62, 64 or 66. Rather, air from the air supply 108 is passed through the conduit 110 and through the conduits 118, 124 and 120 into each of the headers 60, 62, 64 and 66. The air passing through the nozzles in the headers 60, 62, 64 and 66 functions to prevent the nozzles in the headers 60, 62, 64 and 66 from becoming clogged or plugged with coal.

When the pulverizer 10 is shut down, the valve 42 is closed and the coal feeding system is shut down. The valves 44 are closed preventing the coal dust from being passed from the pulverizer 10. The valve 52 is moved to a closed position thereby reducing the flow of hot air into the pulverizer 10 by way of the primary air duct 24. The valve 52 is not designed to be a tight shut off valve.

When the pulverizer 10 is shut down, the solenoid valve 114 closes thereby disconnecting the air supply 108 from the headers 60, 62, 64 and 66. Further, the solenoid valve 104 is opened thereby permitting water from the water supply 88 to be passed into the headers 60, 62 and 64. Water still not passed from the water supply 88 to the swirl header 66 since the solenoid/-manual flow valve 100 initially is in the closed position when the pulverizer 10 first is shut down. The solenoid valves 114 and 104 are operated to close and open respectively automatically upon the shut down of the pulverizer 10. Further, the solenoid valves 114 and 104 each are operated by the adjustable timers 128 and 126 respectively to hold the solenoid valves 114 and 104 in the closed and the opened position respectively for a predetermined period of time such as two minutes.

In the opened position of the solenoid valve 104, water is passed through the headers 60, 62 and 64. The nozzles 72 connected to the upper fogging header 60 spray water into the pulverizer chamber 16 generally near the upper end 12 of the pulverizer 10 with each of the nozzles 72 being positioned to spray water generally toward a central portion of the pulverizer chamber 16. The spraying of water via the nozzle 72 in the upper fogging header 60 functions to cool the air in the pulverizer chamber 16 near the upper end 12 and cooperates to facilitate the movement of the coal dust from the upper end 12 of the pulverizer chamber 16 downwardly toward the lower end 14 and onto the bottom 34 of the pyrite chamber 32.

The spraying of water through the nozzles 74 of the lower fogging header 62 sprays water generally toward a central portion of the pulverizer chamber 16 formed by the pyrite chamber 32 for cooling the air in the pyrite chamber 32 and for facilitating the movement of coal dust in the pyrite chamber 32 onto the bottom 34 of the pyrite chamber 32.

The spraying of water through the nozzles 80 of the primary duct fogging header 64 prevents coal dust from laying out in the primary air duct 24 when the pulverizer 10 is tripped.

After the predetermined period of time such as ten minutes, the adjustable timers 126 and 128 function to close the solenoid valve 104 and open the solenoid valve 114 thereby disconnecting the water from the headers 60, 62 and 64 and connecting the air supply 108 to the headers 60, 62 and 64. The operator then opens the valve 58 for causing $CO_2$ to pass from the $CO_2$ supply 54 into the pulverizer chamber 16. $CO_2$ is permitted to pass into the pulverizer chamber 16 for predetermined period of time such as eight minutes.

Two minutes after the $CO_2$ supply 54 is connected to the pulverizer chamber 16, the operator opens the valve 50 and the operator manually opens the valve 100 thereby connecting the water supply 88 to the swirl header 66. The valve 50 is opened. Water is passed through the nozzles 84 and the swirl header 66 for washing debris near the bottom 34 of the pyrite chamber 32 toward the debris outlet 38. The blades 36 are actuated to rotate and sweep the debris near the bottom 34 of the pyrite chamber 32 toward the debris outlet 38. The nozzles 84 of the swirl header 66 cooperate with the blades 36 for moving the debris through the pyrite chamber 32 and out through the debris outlet 38, such debris being passed to the hopper 46.

After three minutes of water flushing, the operator causes the pulverizer 10 to be started. The operator stops the blades 36 from rotating. The water wash provided via the swirl header 66 should continue for a predetermined period of time such as three minutes after the blades 36 have been deactivated. The operator then closes the solenoid/manual flow valve 100 and releases the pyrite gates to the normal position.

Before starting the pulverizer 10, the water supply 88 again is connected to the headers 60, 62 and 64 for a period of time for spraying into the portions of the pulverizer chamber 16 as an additional safety measure. The operator then proceeds with standard start up procedures of the pulverizer 10 in a manner well known in the art.

Changes may be made in the construction and the operation of the various components, elements and assemblies described herein without departing from the spirit and scope of the invention as defined in the following claims.

What is claimed is:

1. An improvement in a pulverizer having upper end and a lower end wherein coal is passed through an inlet into grinders where the coal is ground into coal dust and the coal dust is blown out of the pulverizer through at least one coal outlet located in the upper end of the pulverizer, the pulverizer having a hot air inlet connected to a primary air duct with hot air being blown through the primary air duct and through the hot air inlet and into the pulverizer for blowing the coal dust out of the pulverizer through the coal outlet, the pulverizer having a pyrite chamber having a bottom located near the lower end of the pulverizer wherein debris is collected and a debris outlet for discharging debris from the pyrite chamber, the pulverizer having means when activated for moving the debris in the pyrite chamber in a direction from the pyrite chamber through the debris outlet, the pulverizer encompassing a pulverizer chamber and the pyrite chamber forming a portion of the pulverizer chamber, the pulverizer including a lower fogging header connected to the pulverizer near the lower end of the pulverizer and disposed in the pyrite chamber, having a plurality of nozzles connected thereto and position for spraying water into the pyrite chamber, and a primary duct fogging header having a plurality of nozzles disposed in the primary air duct for spraying water into the primary air duct, the improvement comprising:

an upper fogging header connected to the pulverizer near the upper end of the pulverizer, having a plurality of nozzles connected thereto and position for spraying water into the pulverizer chamber near the near upper end of the pulverizer for cooling air in the pulverizer chamber near the upper end of the pulverizer and for facilitating the movement of coal dust from the pulverizer chamber near the upper end of the pulverizer onto the bottom of the pyrite chamber;

means for passing water into the upper fogging header, the lower fogging header and the primary duct fogging header; and wherein the pulverizer has a shut down condition wherein coal ceases to be fed to the pulverizer and hot air passed to the pulverizer is reduced, and wherein the means for passing water into the upper fogging header, the lower fogging header and primary duct fogging header, is defined further as passing water into the upper fogging header, the lower fogging header and the primary duct fogging header automatically for a predetermined period of time when the pulverizer is conditioned in the shut down condition.

2. The improvement of claim 1 wherein the upper fogging header is circularly shaped and wherein the nozzles are spaced apart circumferentially about the upper fogging header.

3. The improvement of claim 2 wherein the nozzles on the upper fogging header are positioned to spray water generally toward the center of the pulverizer chamber near the upper end of the pulverizer.

4. An improvement in a pulverizer having upper end and a lower end wherein coal is passed through an inlet into grinders where the coal is ground into coal dust and the coal dust is blown out of the pulverizer through at least one coal outlet located in the upper end of the pulverizer, the pulverizer having a hot air inlet connected to a primary air duct with hot air being blown through the primary air duct and through the hot air inlet and into the pulverizer for blowing the coal dust out of the pulverizer through the coal outlet, the pulverizer having a pyrite chamber having a bottom located near the lower end of the pulverizer wherein debris is collected and a debris outlet for discharging debris from the pyrite chamber, the pulverizer having means when activated for moving the debris in the pyrite chamber in a direction from the pyrite chamber through the debris outlet, the pulverizer encompassing a pulverizer chamber and the pyrite chamber forming a portion of the pulverizer chamber, the pulverizer including a lower fogging header connected to the pulverizer near the lower end of the pulverizer and disposed in the pyrite chamber, having a plurality of nozzles connected thereto and position for spraying water into the pyrite chamber, and a primary duct fogging header having a plurality of nozzles disposed in the primary air duct for spraying water into the primary air duct, the improvement comprising:

an upper fogging header connected to the pulverizer near the upper end of the pulverizer, having a plurality of nozzles connected thereto and position for spraying water into the pulverizer chamber near the near upper end of the pulverizer for cooling air in the pulverizer chamber near the upper end of the pulverizer and for facilitating the movement of coal dust from the pulverizer chamber near the upper end of the pulverizer onto the bottom of the pyrite chamber;

means for passing water into the upper fogging header, the lower fogging header and the primary duct fogging header; and means for causing air to pass into the upper fogging header, the lower fogging header, and the primary duct fogging header when water is not being passed into the upper fogging header, the lower fogging header or the primary duct fogging header during the operation of the pulverizer for preventing the nozzles in the upper fogging header, the lower fogging header and the primary duct fogging header from becoming clogged.

5. An improvement in a pulverizer having upper end and a lower end wherein coal is passed through an inlet into grinders where the coal is ground into coal dust and the coal dust is blown out of the pulverizer through at least one coal outlet located in the upper end of the pulverizer, the pulverizer having a hot air inlet connected to a primary air duct with hot air being blown through the primary air duct and through the hot air inlet and into the pulverizer for blowing the coal dust out of the pulverizer through the coal outlet, the pulverizer having a pyrite chamber having a bottom located near the lower end of the pulverizer wherein debris is collected and a debris outlet for discharging debris from the pyrite chamber, the pulverizer having means when activated for moving the debris in the pyrite chamber in a direction from the pyrite chamber through the debris outlet, the pulverizer encompassing a pulverizer chamber and the pyrite chamber forming a portion of the pulverizer chamber, the pulverizer including a lower fogging header connected to the pulverizer near the lower end of the pulverizer and disposed in the pyrite chamber, having a plurality of nozzles connected thereto and position for spraying water into the pyrite chamber, and a primary duct fogging header having a plurality of nozzles disposed in the primary air duct for spraying water into the primary air duct, the pulverizer having a swirl header connected to the pulverizer and disposed in the pyrite chamber, having a plurality of spray nozzles connected thereto for spraying water into the pyrite chamber, the improvement comprising:

an upper fogging header connected to the pulverizer near the upper end of the pulverizer, having a plurality of nozzles connected thereto and position for spraying water into the pulverizer chamber near the near upper end of the pulverizer for cooling air in the pulverizer chamber near the upper end of the pulverizer and for facilitating the movement of coal dust from the pulverizer chamber near the upper end of the pulverizer onto the bottom of the pyrite chamber;

means for passing water into the upper fogging header, the lower fogging header and the primary duct fogging header; and means for causing air to pass into the upper fogging header, the lower fogging header, the primary duct fogging header and the swirl header when water is not being passed into the upper fogging header, the lower fogging header, the primary duct fogging header and the swirl header during the operation of the pulverizer for preventing the nozzles in the upper fogging header, the lower fogging header, the primary duct fogging header and the swirl header from becoming clogged.

6. An improvement in a pulverizer having upper end and a lower end wherein coal is passed through an inlet into grinders where the coal is ground into coal dust and the coal dust is blown out of the pulverizer through at least one coal outlet located in the upper end of the pulverizer, the pulverizer having a hot air inlet connected to a primary air duct with hot air being blown through the primary air duct and through the hot air inlet and into the pulverizer for blowing the coal dust out of the pulverizer through the coal inlet, the pulverizer having a pyrite chamber having a bottom located near the lower end of the pulverizer wherein debris is collected and a debris outlet for discharging debris from the pyrite chamber, the pulverizer having means when activated for moving the debris in the pyrite chamber in a direction from the pyrite chamber through the debris outlet, the pulverizer encompassing a pulverizer chamber and the pyrite chamber forming a portion of the pulverizer chamber, the pulverizer including a lower fogging header connected to the pulverizer near the lower end of the pulverizer and disposed in the pyrite chamber, having a plurality of nozzles connected thereto and position for spraying water into the pyrite chamber, and a primary duct fogging header having a plurality of nozzles disposed in the primary air duct for spraying water into the primary air duct, the pulverizer having a swirl header connected to the pulverizer and disposed in the pyrite chamber, having a plurality of spray nozzles connected thereto for spraying water into the pyrite chamber, the improvement comprising:

an upper fogging header connected to the pulverizer near the upper end of the pulverizer, having a plurality of nozzles connected thereto and position for spraying water into the pulverizer chamber near the near upper end of the pulverizer for cooling air in the pulverizer chamber near the upper end of the pulverizer and for facilitating the movement of coal dust from the pulverizer chamber near the upper end of the pulverizer onto the bottom of the pyrite chamber;

means for passing water into the upper fogging header, the lower fogging header and the primary duct fogging header; and wherein the pulverizer has a shut down condition wherein coal ceases to be fed to the pulverizer and hot air passed to the pulverizer is reduced, and wherein the means for passing water into the upper fogging header, the lower fogging header and primary duct fogging header, is defined further as passing water into the upper fogging header, the lower fogging header and the primary duct fogging header automatically for a predetermined period of time when the pulverizer is condition in the shut down condition, and after the predetermined period, the water automatically ceases to be passed to the upper fogging header, the lower fogging header and the primary duct fogging header;

means for causing air to pass into the upper fogging header, the lower fogging header, the primary duct fogging header and the swirl header when water is not being passed into the upper fogging header, the lower fogging header, the primary duct fogging header and the swirl header during the operation of the pulverizer for preventing the nozzles in the upper fogging header, the lower fogging header, the primary duct fogging header and the swirl header from becoming clogged; and means for automatically passing water to the swirl header after the water ceases to be passed to the upper fogging header, the lower fogging header, the primary duct fogging header; and wherein the means for moving debris from the pyrite chamber automatically is activated for a predetermined period of time to start removing debris after the water has started to be passed to the swirl header.

* * * * *